US009004035B2

(12) United States Patent
Chu et al.

(10) Patent No.: US 9,004,035 B2
(45) Date of Patent: Apr. 14, 2015

(54) STARTER MOTOR

(75) Inventors: Jun Jie Chu, Hong Kong (CN); Jia Li, Shenzhen (CN)

(73) Assignee: Johnson Electric S.A., Murten (CH)

( * ) Notice: Subject to any disclaimer, the term of this patent is extended or adjusted under 35 U.S.C. 154(b) by 817 days.

(21) Appl. No.: 13/269,162

(22) Filed: Oct. 7, 2011

(65) Prior Publication Data

US 2012/0085306 A1 Apr. 12, 2012

(30) Foreign Application Priority Data

Oct. 9, 2010 (CN) ..... 2010 2 0562505 U

(51) Int. Cl.

| | |
|---|---|
| ***F02N 11/00*** | (2006.01) |
| ***F02N 15/06*** | (2006.01) |
| *F02N 15/02* | (2006.01) |
| *F02N 15/04* | (2006.01) |
| *F02N 15/00* | (2006.01) |

(52) U.S. Cl.

CPC ..... *F02N 15/063* (2013.01); *F02N 15/066* (2013.01); *F02N 15/02* (2013.01); *F02N 15/04* (2013.01); *F02N 11/00* (2013.01); *F02N 15/006* (2013.01); *F02N 15/065* (2013.01)

(58) Field of Classification Search

CPC ..... F02N 15/02; F02N 15/06; F02N 15/066
USPC ..... 123/178.25; 290/38 R, 38 C; 74/7 R
See application file for complete search history.

(56) References Cited

U.S. PATENT DOCUMENTS

| | | | | |
|---|---|---|---|---|
| 2,319,688 | A | 7/1941 | Jones | |
| 2,922,307 | A * | 1/1960 | Buxton | 74/7 R |
| 2,933,926 | A * | 4/1960 | Buxton | 74/7 R |
| 3,071,013 | A | 1/1963 | Antonidis et al. | |
| 3,630,092 | A * | 12/1971 | Matsumoto et al. | 74/517 |
| 3,788,150 | A * | 1/1974 | Matsumoto | 74/7 R |
| 3,791,685 | A * | 2/1974 | Hamman | 290/38 R |
| 4,208,922 | A * | 6/1980 | Mortensen | 74/7 R |
| 4,255,982 | A | 3/1981 | Kern | |
| 4,330,713 | A * | 5/1982 | Greenwood | 290/48 |
| 4,369,666 | A * | 1/1983 | Kern | 74/7 R |
| 4,479,394 | A * | 10/1984 | Greenwood et al. | 74/7 R |
| 4,524,629 | A * | 6/1985 | Digby | 74/7 R |
| 4,528,470 | A * | 7/1985 | Young et al. | 310/78 |
| 4,573,364 | A * | 3/1986 | Givan | 74/7 E |
| 4,739,181 | A * | 4/1988 | Okamoto et al. | 290/38 R |
| 5,046,373 | A * | 9/1991 | Zabrowski et al. | 74/7 R |
| 5,241,871 | A * | 9/1993 | McKnight et al. | 74/7 C |
| 6,466,116 | B1 * | 10/2002 | Ho et al. | 335/126 |
| 6,937,122 | B2 * | 8/2005 | Ho et al. | 335/126 |
| 6,948,392 | B2 * | 9/2005 | Eckard et al. | 74/7 C |
| 6,993,989 | B2 * | 2/2006 | Oomura et al. | 74/7 E |

FOREIGN PATENT DOCUMENTS

| | | |
|---|---|---|
| JP | 1318760 | 12/1989 |

* cited by examiner

*Primary Examiner* — Hieu T Vo
*Assistant Examiner* — Arnold Castro
(74) *Attorney, Agent, or Firm* — Muncy, Geissler, Olds & Lowe, P.C.

(57) ABSTRACT

A starter motor for an internal combustion engine has an electric motor, a shaft driven by the motor, and a pinion assembly arranged to engage a flywheel of the engine. The pinion assembly has a drive collar mounted to a helical spline of the shaft, an output gear and an elastic member disposed between the drive collar and the output gear. A connection shell prevents axial separation between the drive collar and the output gear. The elastic member prevents direct contact between the connection shell and at least one and possibly both of the drive collar and the output gear.

14 Claims, 4 Drawing Sheets

STARTER MOTOR

CROSS REFERENCE TO RELATED APPLICATIONS

This non-provisional patent application claims priority under 35 U.S.C. §119(a) from Patent Application No. 201020562505.4 filed in The People's Republic of China on Oct. 9, 2010.

FIELD OF THE INVENTION

This invention relates to a starter motor for cranking an internal combustion engine and, in particular, to a pinion gear assembly of the starter motor. The pinion gear is used for momentarily engaging a flywheel of the engine and transferring power from the starter motor to the engine.

BACKGROUND OF THE INVENTION

A starter motor usually has an electric motor, a output shaft driven by the electric motor, a drive collar movably engaged with the output shaft, a pinion driven by the drive collar, and an elastic member sandwiched between the drive collar and the pinion. The drive collar moves along the output shaft when the output shaft begins to rotate, which causes the pinion to move along the output shaft to engage the flywheel. Further rotation of the output shaft causes rotation of the drive collar and pinion to rotate the flywheel to crank the engine. The elastic member reduces the shock between the drive collar and the pinion as the pinion engages the flywheel. A connection shell surrounds the elastic member and contacts or bears against the drive collar and the output gear to prevent axial separation of the drive collar, elastic member and output gear.

Direct contact between the connection shell and the drive collar and the output gear causes heat and wear of the connection shell due to the relative rotation between the drive collar and the output gear causing rubbing against the shell. This wear can lead to damage of the shell which may lead to axial separation of the output gear from the drive collar which may result in the output gear remaining engaged with the flywheel after the engine has started leading to rapid failure of the starter motor.

The present invention aims to provide a starter motor with a new pinion assembly which can solve the above problem.

SUMMARY OF THE INVENTION

Accordingly, in one aspect thereof, the present invention provides a starter motor for an internal combustion engine, comprising: an electric motor; a rotatable output shaft driven by the motor, the output shaft having a male helical spline formed thereon; and a pinion assembly comprising: a drive collar mounted on and movable along the output shaft, the drive collar comprises a tubular engaging part extending along the axial direction of the output shaft and an annular plate extending radially outwardly from the engaging part, the engaging part defines a through hole having a female helical spline engaging the male helical spline of the output shaft; an output gear movable along the output shaft and driven by the drive collar; a position member connected to the output shaft, arranged on a side of the output gear remote from the drive collar to limit axial movement of the output gear along the output shaft; an elastic member sandwiched between the drive collar and the output gear; and a connection shell for restricting the output gear from moving away from the drive collar along the output shaft but allowing relative rotational movement about the shaft between the drive collar and the output gear, the connection shell comprising a sleeve part surrounding a radially outer wall of the elastic member and two clamping parts extending radially inwardly from respective ends of the sleeve part, wherein the elastic member comprises a substantially tubular surrounding part and an annular intermediate part radially protruding from the inner wall of the surrounding part, the annular plate being received in a first receiving groove formed by the intermediate part and an end portion of the surrounding part; and wherein the connection shell does not make direct contact with at least one of the drive collar and the output gear.

Preferably, the first clamping part contacts the annular plate, the second clamping part contacts an axial end surface of the surrounding part adjacent the output gear, and the elastic member is fixed to the output gear.

Preferably, the elastic member is fixed to the output gear by form locking shapes.

Preferably, the elastic member is directly molded to the output gear.

Preferably, the elastic member is detachably fixed to the output gear.

Preferably, the first clamping part is fixed to the annular plate.

Preferably, a compression spring compressed is disposed between the output gear and the position member, and a spring sleeve fixed to the output gear, housing the compression spring and extending at least partially over the position member.

Preferably, the output gear comprises a bottom surface that faces the annular plate and a recess formed in the bottom surface, the engaging part being partially housed in the recess.

Preferably, the elastic member further comprises a cover part protruding inwardly from an end of the surrounding part, the cover part being sandwiched between the annular plate and the first clamping part.

Preferably, the output gear further comprises a radially extending flange, the surrounding part comprises a receiving slot that receives the flange.

Preferably, the output gear further comprises a radially extending flange, and the second clamping part is fixed to the flange.

Preferably, the output shaft is a rotor shaft of the electric motor.

Preferably, the elastic member resiliently grips the radially outer surface of the annular plate, thereby increasing the friction between the drive collar and the elastic member.

Preferably, the elastic member forms a barrier between the radially outer surface of the drive collar and an inner surface of the connection shell.

In the embodiments of the present invention, axial separation between the drive collar and the output gear can be avoided without causing wear on the connection shell. In some embodiments, the portion of the output shaft along which the output gear slides, is covered to avoid buildup of dust and debris which could interfere with the smooth movement of the pinion assembly.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
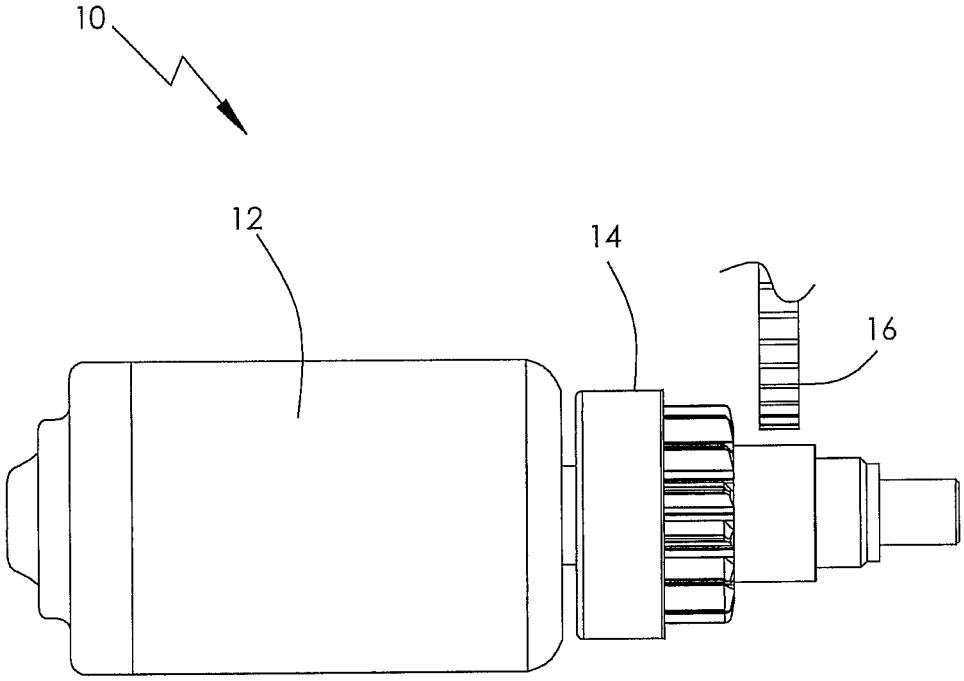
FIG. 1 is schematic side view of a starter motor including a pinion assembly, according to an first embodiment of the present invention.

A starter motor 10, as shown in FIG. 1, is used to drive a flywheel 16 of an internal combustion engine so as to crank or start the engine. The starter motor 10 includes a electric motor 12 and a pinion assembly 14 driven by the motor 12. The pinion gear assembly 14 is shown in more detail in the exploded view of FIG. 2 and the sectional view of FIG. 3. The pinion gear assembly 14 includes an output shaft 20, a drive collar 30, an elastic member 40, an output gear 50, a connection shell 60, a position member 70, and a pressure member 72.

The output shaft 20 can be either a rotor shaft of the electric motor 14 or a separate shaft driven by the electric motor 14. The output shaft 20 includes a stop protrusion 22, a fixing groove 23, and a male helical spline 21 arranged between the stop protrusion 22 and the fixing groove 23. The fixing groove 23 is spaced from the spline 21, near a distal end of the output shaft 20. The stop protrusion 22 is located adjacent to or abutting the spline 21. The diameter of the stop protrusion 22 is greater than that of the spline 21.

The drive collar 30 includes a tubular engaging part 31 and a annular plate 32 extending radially from an end of the engaging part 31. The engaging part 31 defines a through hole 33 having a female helical spline formed therein that mates with the male spline 21 of the output shaft. The output shaft 20 extends through the through hole 33 with the two splines engaging with each other. The drive collar 30 abuts against the stop protrusion 22 when moved to one end of the helical spline 21.

The elastic member 40 includes a substantially tubular surrounding part 41 and an annular intermediate part 42 extending radially inwardly from an inner wall of the surrounding part 41. The elastic member 40 has a first receiving groove 43 defined by the intermediate part 42 and one end of the surrounding part 41, for receiving the annular plate 32, and a second receiving groove 44 defined by the intermediate part 42 and the other end of the surrounding part 41, for receiving gear teeth 51 of the output gear 50 (see below). The intermediate part 42 has a hole 45 through which the engaging part 31 extends. The elastic member 40 sleeves the drive collar 30 with the annular plate 32 received in the first receiving groove 43.

The output gear 50 includes a number of gear teeth 51 arranged on a peripheral surface thereof, a top surface 54, and a bottom surface 55. The output gear 50 has a substantial cylindrical recess 52 formed in the bottom surface 55 and a opening 57 running through the top surface 54 and communicating with the recess 52, for slidably receiving and being rotatably supported by the output shaft. The output gear 50 also has a first spring groove 53 in the top surface 54, surrounding the opening 57, and a fixing groove 58 in the top surface 54, surrounding the first spring groove 53. The diameter of the recess 52 is slightly greater than the outer diameter of the engaging part 31. The engaging part 31 is partially housed in the recess 52, which shortens the axial length of the pinion assembly 14. The output gear 50 is fixed to the elastic member 40 and a side of the output gear 50 corresponding to the bottom surface 55 is received in the second receiving groove 44. By covering the radially outer surface of the annular plate, the elastic member can grip the drive collar to aid assembly, avoid direct contact between the sleeve part and the annular plate and increase friction between the drive member and the elastic member.

The connection shell 60 has a tubular sleeve part 62, with a first clamping part 61 extending inwardly from one end of the sleeve part 62, and a second clamping part 63 extending inwardly from the other end of the sleeve part 62. The sleeve part 62 sleeves the outer wall of the surrounding part 41 of the elastic member 40. The first clamping part 61 at least partially covers an end face of the annular plate 32 remote from the pinion gear. The second clamping part 63 contacts an axial end surface of the surrounding part 41 adjacent the output gear 50. As such, the drive collar 30 and the elastic member 40 are tightly housed in the connection shell 60. The output gear 50 is restricted from moving away from the drive collar 30 along the output shaft 20 by being fixed to the elastic member.

The position member 70 includes a snap ring 76 partially received in the fixing groove 23 and a substantially tubular abutting part 71. The abutting part 71 sleeves part of the output shaft 20 and is rotatably connected to the output shaft 20 by the snap ring 76. That is, the snap ring 76 prevents the position member 70 from being removed from the output shaft. The abutting part 71 defines a second spring groove 75 facing towards the output gear 50.

The pressure member 72 includes a compression spring 73 and a tubular spring sleeve 74. The spring 73 is received in the first spring groove 53 of the output gear 50 and the second spring groove 75. The spring 73 is partially compressed in the normal condition. One end of the spring sleeve 74 is fixed in the fixing groove 58 while the other end of the sleeve 74 partially surrounds the abutting part 71, so that the spring 73 is housed in the sleeve 74. As such, the spring 73 is protected by the sleeve 74. Preferably, in the fully compressed state, the spring 73 is received entirely within the first spring groove and the second spring groove, with the output gear 50 making direct contact with the position member 70. The spring sleeve 74 also protects the otherwise exposed portion of the output shaft along which the output gear slides, from debris and dust build up.

In operation, upon energization of the motor 12, the rotation of the shaft 20 causes the drive collar 30 to move the output gear 50 towards the flywheel 16 due to relative rotation between the shaft 20 and the drive collar 30. Initially, due to inertia, the drive collar does not rotate with the shaft, resulting in the two splines 21,33 moving the drive collar axially along the shaft 20. The output gear 50 is also moved axially along the output shaft against the urging of the spring 73, until it contacts the position member 70 at which location the output gear is engaged with the flywheel 16 and the spring 73 is further compressed. As high torsion is required to rotate the flywheel 16 and as the elastic member 40 is not fixed to the drive collar 30, the drive collar 30 may rotate relative to the output gear 50. However, as the shaft 20 continues to rotate, the drive collar 30 keeps moving towards the flywheel 16 so as to compress the intermediate part 42 of the elastic member 40 until the friction between the drive collar and the elastic member is sufficient to cause the output gear and thus the flywheel to rotate with the drive collar. intermediate part transmits torsion from the drive collar 30 to the flywheel 16 via the output gear 50. Thus, the engine is rotated by the starter motor 10.

Once the engine starts, the electric motor 12 is de-energized. However, once the flywheel rotates the drive collar faster than the output shaft, the splines will move the drive collar back towards the stop protrusion, aided by the spring 73 pressing against the output gear. As the output gear 50 is connected to the drive collar 30 by the elastic member 40 and the connection shell 60, the output gear 50 therefore moves with the drive collar 30, which ensures the output gear 50 disengages from the flywheel 16. The disengagement will be maintained by the spring 73. Thus, the output gear 50 will successfully disengage from the flywheel 16 after the engine starts.

Figure 4:
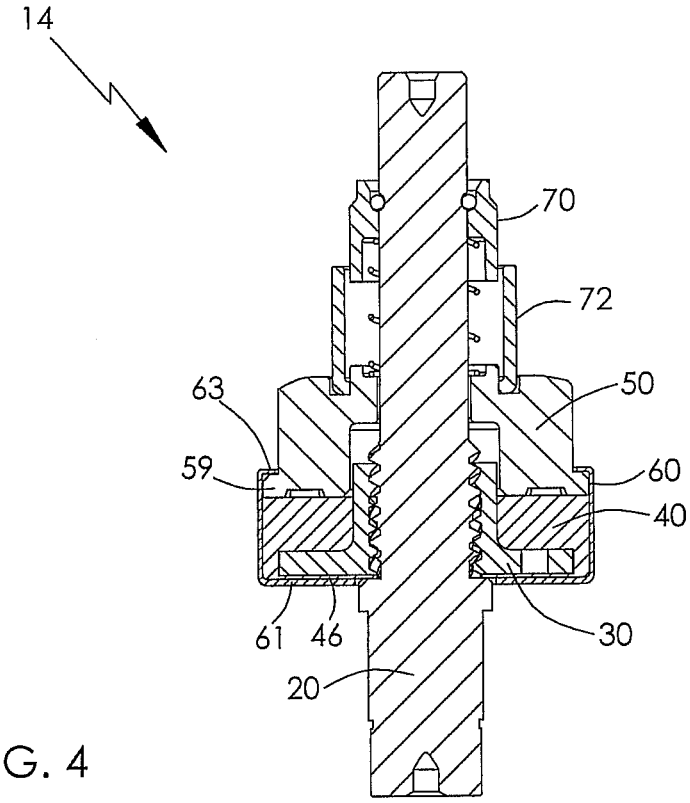
FIG. 4 is sectional view of an pinion assembly, according to a second embodiment of the present invention.

It should be understood that the configuration of the pinion assembly 14 is not limited to the above-mentioned embodiment as long as the output gear 50 is restricted from moving away form the drive collar 30 along the output shaft 20 by the connection shell 60. For example, as shown in FIG. 4, the output gear 50 may include a flange 59 forming a radial extension of the bottom surface, while the elastic member 40 defines no second receiving groove 44 like in the above-mentioned embodiment. The second clamping part 63 connects to the flange 59. In this embodiment, the output gear 50 is not fixed to the elastic member 40 and the elastic member 60 may be either fixed or not fixed to the drive collar 30. Preferably, as shown in FIG. 4, the elastic member has a radial cover part 46 extending inwardly from an end of the surrounding part which at least partially covers the axially outer or bottom surface of the annular plate 32. The cover part 46 forms a barrier between the first clamping part 61 and the annular plate preventing direct contact between the connection shell and the drive collar. Preferably the elastic member is molded directly to the drive collar to form the cover part.

Figure 5:
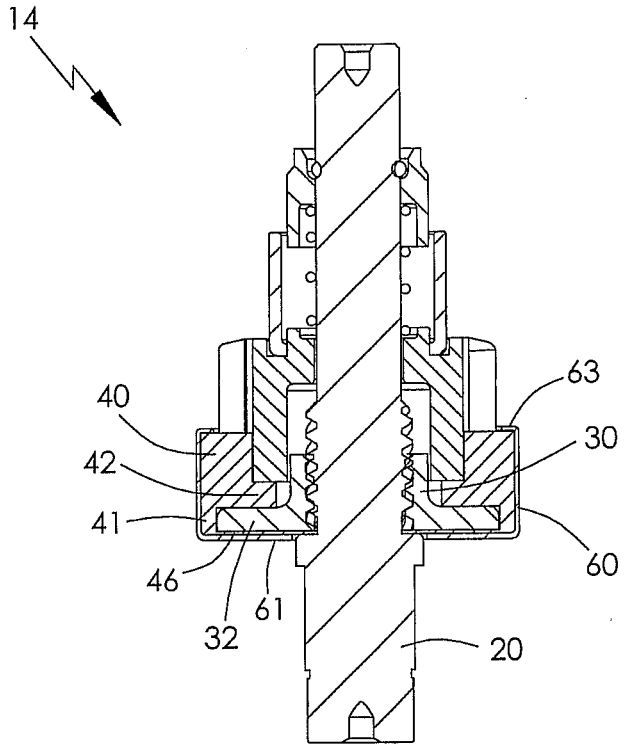
FIG. 5 is a sectional view of an pinion assembly, according to a third embodiment of the present invention.

As the output gear 50 moves towards the flywheel 16, the drive collar 30 and/or output gear 50 may rotate relative to the connection shell 60. However, as the elastic member 40 is sandwiched between the drive collar 30, the output gear 50 and the connection shell 60, direct contact between the output gear 50 and/or drive collar and the connection shell 60 is avoided. If the first clamping part 61 is fixed to the annular plate 32, such as by welding or form locks so as to rotate with the drive collar, wear between the drive collar and the shell is also eliminated. However, in a further embodiment, as shown in FIG. 5, the elastic member 40 may further include a cover part 46 covering the annular plate 32, similar to that shown in FIG. 4, so as to eliminate direct contact between the bottom surface of the annular plate 32 and the connection shell 60.

Figure 6:
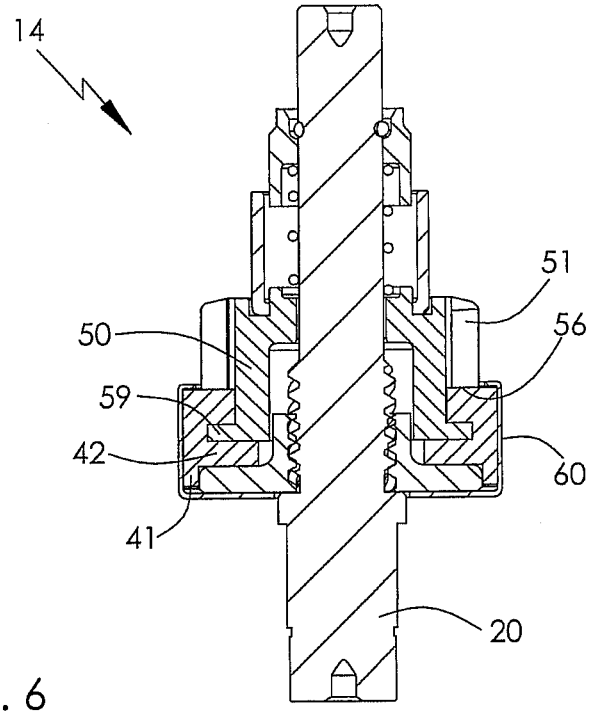
FIG. 6 is a sectional view of an pinion assembly, according to a fourth embodiment of the present invention.

According to another embodiment, as shown in FIG. 6, the elastic member 40 may house a flange 59 of the output gear 50. In this case, the output gear 50 may be releasably fixed to the elastic member 40 with the flange being disposed in a slot formed by the second receiving groove. The second clamping part holds the output gear via the elastic member thus avoiding direct contact between the connection shell and the output gear.

Figure 2:
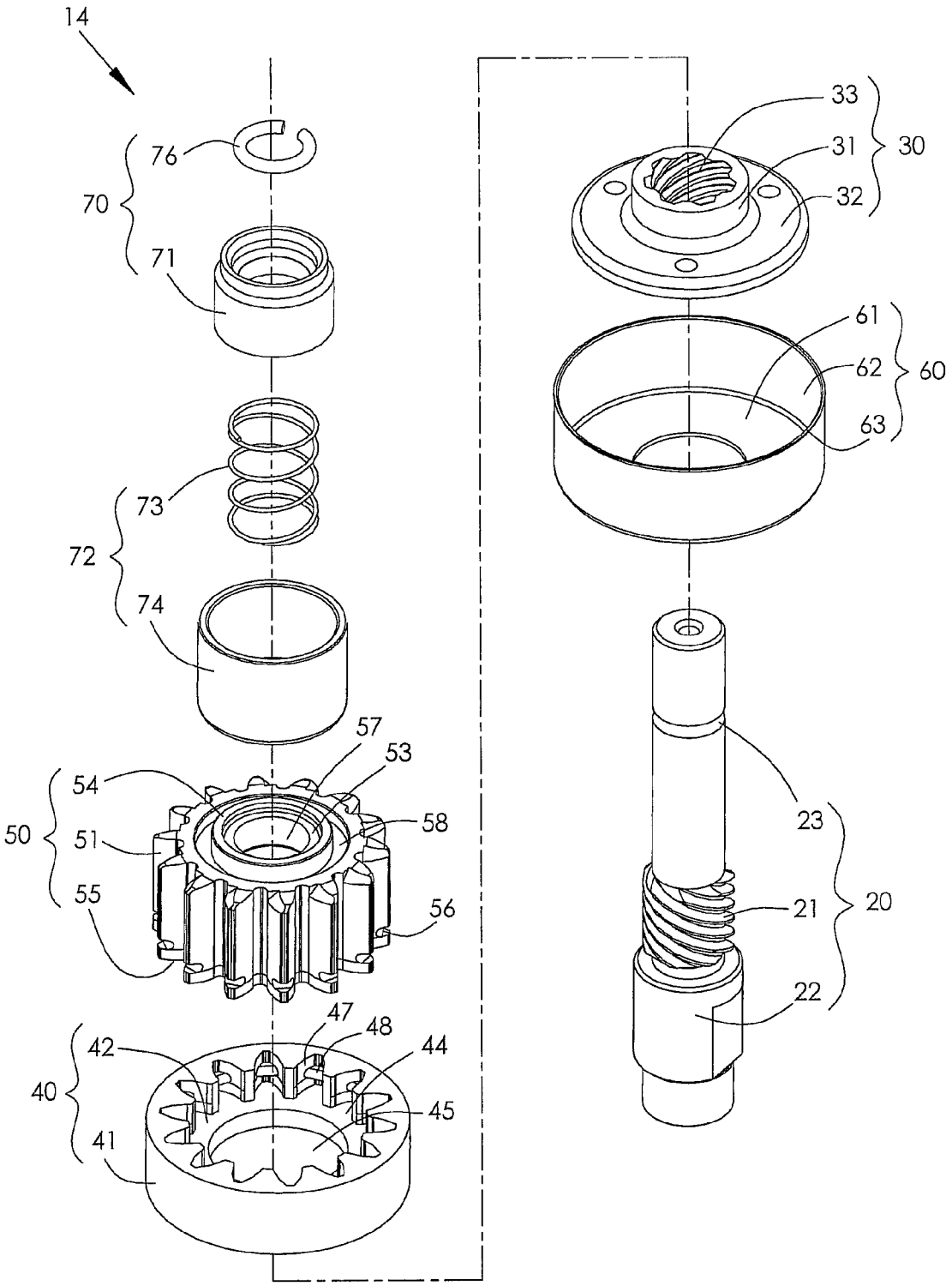
FIG. 2 is an exploded view of the pinion assembly of FIG. 1.
Figure 3:
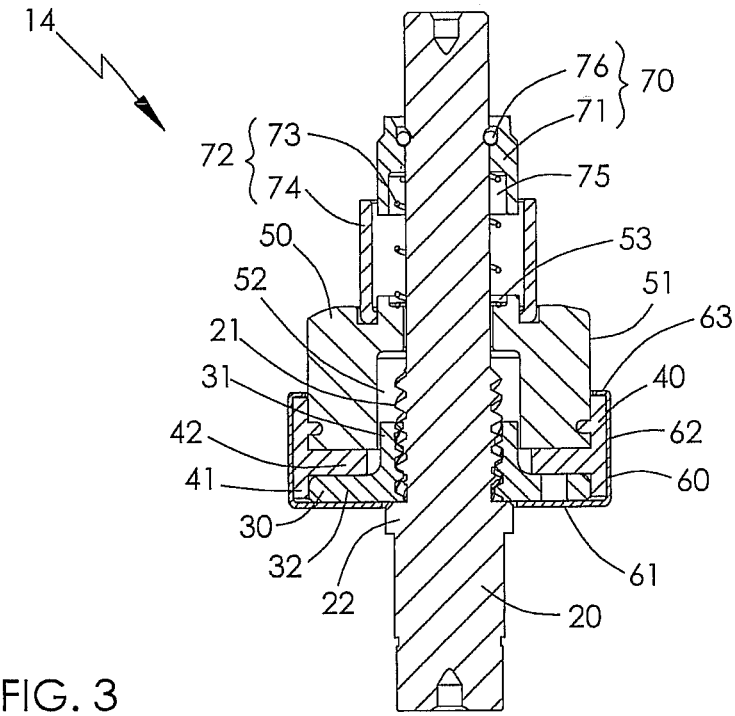
FIG. 3 is sectional view of the pinion assembly of FIG. 1.

By 'fixed', we mean that the elastic member is attached to the output gear or drive collar by a permanent attachment such as bonding, gluing, vulcanizing and over-molding, or a releasable attachment such as by resilient gripping of the other part by the elastic member or by an interlocking arrangement between the parts concerned. For example, as shown in FIG. 2, the output gear may have a circumferential slot 56 formed in its radially outer surface or cut through the gear teeth 51 and the elastic member has a plurality of depressions 47 formed in the circumferential wall of the second receiving groove 44 for accommodating the ends of the gear teeth 51 and each depression 47 having a ridge 48 extending in a generally circumferential direction so to mate with the slot 56 to fix the elastic member 40 to the output gear 50. The elastic member may be preformed and fitted to the output gear or preferably, the elastic member is molded directly to the output gear with the slot, gear teeth, depressions and ridges creating a form lock structure fixing the elastic member to the output gear.

In each of the embodiments shown and discussed, the engaging part 31 of the drive collar 30, extends into the recess 52 in the output gear 50. This allows the pinion assembly to be axially compact without significantly reducing the axial length of the engaging part. Normally, to reduce the axial length of the pinion assembly, the length of the engaging member would be reduced. However, reducing the length of the engaging part results in the drive collar not being properly supported on the spline connection with the shaft, resulting in the driving being easily tilted and jamming on the shaft. This invention avoids this problem.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A starter motor for an internal combustion engine, comprising:

an electric motor;

a rotatable output shaft driven by the motor, the output shaft having a male helical spline formed thereon; and a pinion assembly comprising:

a drive collar mounted on and movable along the output shaft, the drive collar comprises a tubular engaging part extending along the axial direction of the output shaft and an annular plate extending radially outwardly from the engaging part, the engaging part defines a through hole having a female helical spline engaging the male helical spline of the output shaft;

an output gear movable along the output shaft and driven by the drive collar;

a position member connected to the output shaft, arranged on a side of the output gear remote from the drive collar to limit axial movement of the output gear along the output shaft;

an elastic member sandwiched between the drive collar and the output gear; and a connection shell for restricting the output gear from moving away from the drive collar along the output shaft but allowing relative rotational movement about the shaft between the drive collar and the output gear, the connection shell comprising a sleeve part surrounding a radially outer wall of the elastic member and two clamping parts extending radially inwardly from respective ends of the sleeve part, wherein the elastic member comprises a substantially tubular surrounding part and an annular intermediate part radially protruding from the inner wall of the surrounding part, one axial end portion of the surrounding part away from the output gear being axially beyond the intermediate part, the annular plate being received in a first receiving groove formed by the intermediate part and said axial end portion of the surrounding part; and wherein the connection shell does not make direct contact with at least one of the drive collar and the output gear.

2. The starter motor of claim 1, wherein the first clamping part contacts the annular plate, the second clamping part contacts an axial end surface of the surrounding part adjacent the output gear, and the elastic member is fixed to the output gear.

3. The starter motor of claim 2, wherein the elastic member is fixed to the output gear by form locking shapes.

4. The starter motor of claim 2, wherein the elastic member is directly molded to the output gear.

5. The starter motor of claim 2, wherein the elastic member is detachably fixed to the output gear.

6. The starter motor of claim 2, wherein the first clamping part is fixed to the annular plate.

7. The starter motor of claim 1, further comprising a compression spring compressed between the output gear and the position member, and a spring sleeve fixed to the output gear, housing the compression spring and extending at least partially over the position member with such that the spring sleeve is axially overlapped the position member.

8. A starter motor for an internal combustion engine, comprising:

an electric motor;

a rotatable output shaft driven by the motor, the output shaft having a male helical spline formed thereon; and a pinion assembly comprising:

a drive collar mounted on and movable along the output shaft, the drive collar comprises a tubular engaging part extending along the axial direction of the output shaft and an annular plate extending radially outwardly from the engaging part, the engaging part defines a through hole having a female helical spline engaging the male helical spline of the output shaft;

an output gear movable along the output shaft and driven by the drive collar;

a position member connected to the output shaft, arranged on a side of the output gear remote from the drive collar to limit axial movement of the output gear along the output shaft;

an elastic member sandwiched between the drive collar and the output gear; and a connection shell for restricting the output gear from moving away from the drive collar along the output shaft but allowing relative rotational movement about the shaft between the drive collar and the output gear, the connection shell comprising a sleeve part surrounding a radially outer wall of the elastic member and two clamping parts extending radially inwardly from respective ends of the sleeve part, wherein the elastic member comprises a substantially tubular surrounding part and an annular intermediate part radially protruding from the inner wall of the surrounding part, the annular plate being received in a first receiving groove formed by the intermediate part and an end portion of the surrounding part; and wherein the connection shell does not make direct contact with at least one of the drive collar and the output gear, wherein the output gear comprises a bottom surface that faces the annular plate and a recess formed in the bottom surface, the engaging part being partially housed in the recess.

9. A starter motor for an internal combustion engine, comprising:

an electric motor;

a rotatable output shaft driven by the motor, the output shaft having a male helical spline formed thereon; and a pinion assembly comprising:

a drive collar mounted on and movable along the output shaft, the drive collar comprises a tubular engaging part extending along the axial direction of the output shaft and an annular plate extending radially outwardly from the engaging part, the engaging part defines a through hole having a female helical spline engaging the male helical spline of the output shaft;

an output gear movable along the output shaft and driven by the drive collar;

a position member connected to the output shaft, arranged on a side of the output gear remote from the drive collar to limit axial movement of the output gear along the output shaft;

an elastic member sandwiched between the drive collar and the output gear; and a connection shell for restricting the output gear from moving away from the drive collar along the output shaft but allowing relative rotational movement about the shaft between the drive collar and the output gear, the connection shell comprising a sleeve part surrounding a radially outer wall of the elastic member and two clamping parts extending radially inwardly from respective ends of the sleeve part, wherein the elastic member comprises a substantially tubular surrounding part and an annular intermediate part radially protruding from the inner wall of the surrounding part, the annular plate being received in a first receiving groove formed by the intermediate part and an end portion of the surrounding part; and wherein the connection shell does not make direct contact with at least one of the drive collar and the output gear, wherein the elastic member further comprises a cover part protruding inwardly from an end of the surrounding part, the cover part being sandwiched between the annular plate and the first clamping part.

10. A starter motor for an internal combustion engine, comprising:

an electric motor;

a rotatable output shaft driven by the motor, the output shaft having a male helical spline formed thereon; and a pinion assembly comprising:

a drive collar mounted on and movable along the output shaft, the drive collar comprises a tubular engaging part extending along the axial direction of the output shaft and an annular plate extending radially outwardly from the engaging part, the engaging part defines a through hole having a female helical spline engaging the male helical spline of the output shaft;

an output gear movable along the output shaft and driven by the drive collar;

a position member connected to the output shaft, arranged on a side of the output gear remote from the drive collar to limit axial movement of the output gear along the output shaft;

an elastic member sandwiched between the drive collar and the output gear; and a connection shell for restricting the output gear from moving away from the drive collar along the output shaft but allowing relative rotational movement about the shaft between the drive collar and the output gear, the connection shell comprising a sleeve part surrounding a radially outer wall of the elastic member and two clamping parts extending radially inwardly from respective ends of the sleeve part, wherein the elastic member comprises a substantially tubular surrounding part and an annular intermediate part radially protruding from the inner wall of the surrounding part, the annular plate being received in a first receiving groove formed by the intermediate part and an end portion of the surrounding part; and wherein the connection shell does not make direct contact with at least one of the drive collar and the output gear, wherein the output gear further comprises a radially extending flange, the surrounding part has a slot that receives the flange.

11. The starter motor of claim 1, wherein the output gear further comprises a radially extending flange, and the second clamping part is fixed to the flange.

12. The starter motor of claim 1, wherein the output shaft is a rotor shaft of the electric motor.

13. The starter motor of claim 1, wherein the elastic member resiliently grips the radially outer surface of the annular plate.

14. The starter motor of claim 1, wherein the elastic member forms a barrier between the radially outer surface of the drive collar and an inner surface of the connection shell.

* * * * *